US008386246B2

(12) United States Patent
Chen

(10) Patent No.: US 8,386,246 B2
(45) Date of Patent: Feb. 26, 2013

(54) LOW-COMPLEXITY FRAME ERASURE CONCEALMENT

(75) Inventor: Juin-Hwey Chen, Irvine, CA (US)

(73) Assignee: Broadcom Corporation, Irvine, CA (US)

( * ) Notice: Subject to any disclaimer, the term of this patent is extended or adjusted under 35 U.S.C. 154(b) by 920 days.

(21) Appl. No.: 12/147,781

(22) Filed: Jun. 27, 2008

(65) Prior Publication Data

US 2009/0006084 A1 Jan. 1, 2009

Related U.S. Application Data

(60) Provisional application No. 60/946,432, filed on Jun. 27, 2007.

(51) Int. Cl.
*G10L 19/14* (2006.01)

(52) U.S. Cl. ..... 704/211; 704/200; 704/201; 704/207; 704/219; 704/228; 704/268

(58) Field of Classification Search ..... 704/200, 704/201, 207, 228, 268
See application file for complete search history.

(56) References Cited

U.S. PATENT DOCUMENTS

| | | | | |
|---|---|---|---|---|
| 5,615,298 | A | 3/1997 | Chen | |
| 5,619,004 | A * | 4/1997 | Dame | 84/616 |
| 5,812,967 | A * | 9/1998 | Ponceleon et al. | 704/207 |
| 5,864,795 | A * | 1/1999 | Bartkowiak | 704/216 |
| 6,199,035 | B1 * | 3/2001 | Lakaniemi et al. | 704/207 |
| 6,757,654 | B1 * | 6/2004 | Westerlund et al. | 704/262 |
| 7,047,190 | B1 * | 5/2006 | Kapilow | 704/228 |
| 7,233,897 | B2 * | 6/2007 | Kapilow | 704/229 |
| 7,424,434 | B2 * | 9/2008 | Chen et al. | 704/500 |
| 7,593,847 | B2 * | 9/2009 | Oh | 704/207 |
| 7,711,563 | B2 * | 5/2010 | Chen | 704/262 |
| 7,752,038 | B2 * | 7/2010 | Laaksonen et al. | 704/207 |
| 7,908,140 | B2 * | 3/2011 | Kapilow | 704/228 |
| 7,930,176 | B2 * | 4/2011 | Chen | 704/228 |
| 8,010,350 | B2 * | 8/2011 | Zopf | 704/207 |
| 8,185,384 | B2 * | 5/2012 | Sun et al. | 704/207 |
| 8,214,206 | B2 * | 7/2012 | Thyssen et al. | 704/228 |
| 8,255,207 | B2 * | 8/2012 | Vaillancourt et al. | 704/219 |
| 8,265,145 | B1 * | 9/2012 | Pejhan et al. | 375/240.11 |
| 2003/0177002 | A1 * | 9/2003 | Chen | 704/207 |

(Continued)

OTHER PUBLICATIONS

Myron J. Ross, et al., "Average Magnitude Difference Function Ptich Extractor," IEEE Transactions on Acoustics, Speech, and Signal Processing, vol. ASSP-22, No. 5, Oct. 1974, pp. 353-362.*

(Continued)

*Primary Examiner* — Pierre-Louis Desir
*Assistant Examiner* — Fariba Sirjani
(74) *Attorney, Agent, or Firm* — Fiala & Weaver P.L.L.C.

(57) ABSTRACT

A system is described that performs frame erasure concealment to generate frames of an output speech signal corresponding to a series of erased frames of encoded bit-stream in a manner that conceals the quality-degrading effects of such erased frames. In one embodiment, responsive to the detection of a first erased frame in the series, a number of steps are performed. These steps include deriving long-term and short synthesis filters based on previously-generated portions of the output speech signal, calculating a ringing signal segment based on the long-term and short-term synthesis filters, and generating a frame of the output speech signal corresponding to the first erased frame by overlap adding the ringing signal segment to an extrapolated waveform. Deriving the long-term filter includes estimating a pitch period based on a previously-generated portion of the output speech signal by finding a lag that minimizes a sum of magnitude difference function.

31 Claims, 4 Drawing Sheets

U.S. PATENT DOCUMENTS

| | | | | |
|---|---|---|---|---|
| 2005/0043959 | A1* | 2/2005 | Stemerdink et al. | 704/500 |
| 2005/0091046 | A1* | 4/2005 | Thyssen et al. | 704/211 |
| 2006/0265216 | A1 | 11/2006 | Chen | |
| 2007/0282601 | A1* | 12/2007 | Li | 704/207 |
| 2010/0305944 | A1* | 12/2010 | Sun | 704/207 |
| 2010/0305953 | A1* | 12/2010 | Susan et al. | 704/500 |

OTHER PUBLICATIONS

R. Hagen, E. Paksoy, and A. Gersho, "Voicing-Specific LPC Quantization for Variable-Rate Speech Coding," IEEE trans. Speech and Audio Processing, vol. 7, No. 5, pp. 485-494, Sep. 1999.*

Lawrence R. Rabiner, et al., "A Comparative Performance Study of Several Pitch Detection Algorithms," IEEE Transactions on Acoustics, Speech, and Signal Processing, Vol. ASSP-24, No. 5, Oct. 1976, pp. 399-418.*

Goodman, et al., "Waveform Substitution Techniques for Recovering Missing Speech Segments in Packet Voice Communications", IEEE Transaction on Acoustics, Speech and Signal Processing, (Dec. 1986), pp. 1440-1448.

"ITU-T Recommendation G.711—Appendix I: A High Quality Low-Complexity Algorithm for Packet Loss Concealment with G.711", prepared by ITU-T Study Group 16, (Sep. 1999), 26 pages.

* cited by examiner

LOW-COMPLEXITY FRAME ERASURE CONCEALMENT

CROSS-REFERENCE TO RELATED APPLICATIONS

This application claims priority to U.S. Provisional Patent Application No. 60/946,432 entitled "Low-Complexity Packet Loss Concealment," filed Jun. 27, 2007, the entirety of which is incorporated by reference herein.

BACKGROUND OF THE INVENTION

1. Field of the Invention

The present invention relates to digital communication systems. More particularly, the present invention relates to the enhancement of speech quality when portions of a bit stream representing a speech signal are lost within the context of a digital communications system.

2. Background Art

In speech coding (sometimes called "voice compression"), a coder encodes an input speech or audio signal into a digital bit stream for transmission. A decoder decodes the bit stream into an output speech signal. The combination of the coder and the decoder is called a codec. The transmitted bit stream is usually partitioned into segments called frames, and in packet transmission networks, each transmitted packet may contain one or more frames of a compressed bit stream. In wireless or packet networks, sometimes the transmitted frames or packets are erased or lost. This condition is called frame erasure in wireless networks and packet loss in packet networks. When this condition occurs, to avoid substantial degradation in output speech quality, the decoder needs to perform frame erasure concealment (FEC) or packet loss concealment (PLC) to try to conceal the quality-degrading effects of the lost frames. Because the terms FEC and PLC generally refer to the same kind of technique, they can be used interchangeably. Thus, for the sake of convenience, the term "frame erasure concealment", or FEC, is used herein to refer to both.

One of the earliest FEC techniques is waveform substitution based on pattern matching, as proposed by Goodman, et al. in "Waveform Substitution Techniques for Recovering Missing Speech Segments in Packet Voice Communications", *IEEE Transaction on Acoustics, Speech and Signal Processing*, December 1986, pp. 1440-1448. This scheme was applied to a Pulse Code Modulation (PCM) speech codec that performs sample-by-sample instantaneous quantization of a speech waveform directly. This FEC scheme uses a piece of decoded speech waveform that immediately precedes the lost frame as a template, and then slides this template back in time to find a suitable piece of decoded speech waveform that maximizes some sort of waveform similarity measure (or minimizes a waveform difference measure).

Goodman's FEC scheme then uses the section of waveform immediately following a best-matching waveform segment as the substitute waveform for the lost frame. To eliminate discontinuities at frame boundaries, the scheme also uses a raised cosine window to perform an overlap-add operation between the correctly decoded waveform and the substitute waveform. This overlap-add technique increases the coding delay. The delay occurs because at the end of each frame, there are many speech samples that need to be overlap-added, and thus final values cannot be determined until the next frame of speech is decoded.

Based on the work of Goodman as described above, David Kapilow developed a more sophisticated version of an FEC scheme for the G.711 PCM codec. This FEC scheme is described in Appendix I of the ITU-T Recommendation G.711.

The FEC scheme of Goodman and the FEC scheme of Kapilow are both limited to PCM codecs that use instantaneous quantization. Such PCM codecs are block-independent; that is, there is no inter-frame or inter-block codec memory, so the decoding operation for one block of speech samples does not depend on the decoded speech signal or speech parameters in any other block.

All PCM codecs are block-independent codecs, but a block-independent codec does not have to be a PCM codec. For example, a codec may have a frame size of 20 milliseconds (ms), and within this 20 ms frame there may be some codec memory that makes the decoding of certain speech samples in the frame dependent on decoded speech samples or speech parameters from other parts of the frame. However, as long as the decoding operation of each 20 ms frame does not depend on decoded speech samples or speech parameters from any other frame, then the codec is still block-independent.

One advantage of a block-independent codec is that there is no error propagation from frame to frame. After a frame erasure, the decoding operation of the very next good frame of transmitted speech data is completely unaffected by the erasure of the immediately preceding frame. In other words, the first good frame after a frame erasure can be immediately decoded into a good frame of output speech samples.

For speech coding, the most popular type of speech codec is based on predictive coding. Perhaps the first publicized FEC scheme for a predictive codec is a "bad frame masking" scheme in the original TIA IS-54 VSELP standard for North American digital cellular radio (rescinded in September 1996). One of the first FEC schemes for a predictive codec that performs waveform extrapolation in the excitation domain is the FEC system developed by Chen for the ITU-T Recommendation G.728 Low-Delay Code Excited Linear Predictor (CELP) codec, as described in U.S. Pat. No. 5,615,298 issued to Chen, entitled "Excitation Signal Synthesis During Frame Erasure or Packet Loss." After the publication of these early FEC schemes for predictive codecs, many, many other FEC schemes have been proposed for predictive codecs, some of which are quite sophisticated.

Despite the fact that most of the speech codecs standardized in the last 20 years are predictive codecs, there are still some applications, such as Voice over Internet Protocol (VoIP), where the G.711 (8-bit logarithmic PCM) codec, or even the 16-bit linear PCM codec, is still used in order to ensure very high signal fidelity. In such applications, none of the advanced FEC schemes developed for predictive codecs can be used, and typically G.711 Appendix I (Kapilow's FEC scheme) is used instead. However, G.711 Appendix I has the following drawbacks: (1) it requires an additional delay of 3.75 ms due to the overlap-add, (2) it has a fairly large state memory requirement due to the use of a long history buffer with a length of three and a half times the maximum pitch period, and (3) its performance is not as good as it can be.

Commonly-owned, co-pending U.S. patent application Ser. No. 11/234,291 to Chen, entitled "Packet Loss Concealment For Block-Independent Speech Codecs," filed on Sep. 26, 2005, describes an FEC scheme that avoids the three drawbacks of G.711 Appendix I mentioned above. However, for certain applications of FEC, such as Bluetooth™ headset applications, the emphasis is on extremely low complexity due to the low cost and low power dissipation requirements. Although the FEC scheme described in U.S. patent application Ser. No. 11/234,291 does not introduce additional delay, has lower state memory requirement than G.711 Appendix I, and produces better speech quality than G.711 Appendix I, its computational complexity and required code size may still exceed the limit for some extremely low complexity applications.

What is needed, therefore, is an FEC technique that maintains the benefits of the FEC scheme described in U.S. patent application Ser. No. 11/234,291 and yet has much lower computational complexity and code size. This means that (1) the number of processor cycles required to implement this FEC technique should be substantially lower both in the worst-case scenario and in the average sense, (2) the algorithm steps and program control should be substantially simpler, (3) no additional delay can be introduced, (4) the state memory requirements should be substantially lower than G.711 Appendix I, and (5) the output speech quality should be substantially better than G.711 Appendix I for the intended low-complexity application.

SUMMARY OF THE INVENTION

As described herein, an embodiment of the present invention performs frame erasure concealment (FEC) to generate frames of an output speech signal corresponding to erased frames of encoded bit-stream in a manner that conceals the quality-degrading effects of such erased frames. An embodiment of the invention may advantageously achieve benefits associated with an FEC technique such as that described in U.S. patent application Ser. No. 11/234,291 while allowing for reduced computational complexity and code size.

In particular, a method is described herein for processing a series of erased frames of an encoded-bit stream to generate corresponding frames of an output speech signal. In accordance with the method, a frame of the output speech signal is generated that corresponds to a first erased frame in the series of erased frames. Then a frame of the output speech signal is generated that corresponds to a subsequent erased frame in the series of erased frames.

The generation of the frame of the output speech signal corresponding to the first erased frame in the series of erased frames includes a number of steps. First, a first extrapolated waveform segment is extrapolated based on a first previously-generated portion of the output speech signal. A ringing signal segment is then overlap-added to the first extrapolated waveform segment to generate an overlap-added waveform segment. A second extrapolated waveform segment is then extrapolated based on the first previously-generated portion of the output speech signal and/or the overlap-added waveform segment. The first portion of the second extrapolated waveform segment is then appended to the overlap-added waveform segment to generate the frame of the output speech signal corresponding to the first erased frame.

The generation of the frame of the output speech signal corresponding to the subsequent erased frame in the series of erased frames also includes a number of steps. First, a third extrapolated waveform segment is extrapolated based on a second previously-generated portion of the output speech signal. Then, a first portion of the third extrapolated waveform segment is appended to a second portion of the second extrapolated waveform segment to generate the frame of the output speech signal corresponding to the subsequent erased frame.

A method is also described herein for processing frames of an encoded bit-stream to generate corresponding frames of an output speech signal. In accordance with the method, one or more non-erased frames of the encoded bit-stream are decoded to generate one or more corresponding frames of the output speech signal. A first erased frame of the encoded bit-stream is then detected. Responsive to the detection of the first erased frame a number of steps are performed. These steps include deriving a short-term synthesis filter, deriving a long-term synthesis filter, calculating a ringing signal segment based on the long-term synthesis filter and the short-term synthesis filter, and generating a frame of the output speech signal corresponding to the first erased frame by overlap adding the ringing signal segment to an extrapolated waveform. In accordance with the foregoing, deriving the short-term synthesis filter includes calculating short-term synthesis filter coefficients and setting up a short-term synthesis filter memory while deriving the long-term synthesis filter includes calculating a pitch period, a long-term synthesis filter memory, and a long-term synthesis filter memory scaling factor.

Another method is described herein for processing frames of an encoded bit-stream to generate corresponding frames of an output speech signal. In accordance with this method, one or more non-erased frames of the encoded bit-stream are decoded to generate one or more corresponding frames of the output speech signal. A first erased frame of the encoded bit-stream is then detected. Responsive to the detection of the first erased frame a number of steps are performed. These steps include deriving a long-term synthesis filter and a short-term synthesis filter based on previously-generated portions of the output speech signal, calculating a ringing signal segment based on the long-term synthesis filter and the short-term synthesis filter, and generating a frame of the output speech signal corresponding to the first erased frame by overlap adding the ringing signal segment to an extrapolated waveform. In accordance with the foregoing, deriving the long-term filter includes estimating a pitch period based on a previously-generated portion of the output speech signal. Estimating the pitch period includes finding a lag that minimizes a sum of magnitude difference function (SMDF).

Yet another method is described herein for processing frames of an encoded bit-stream to generate corresponding frames of an output speech signal. In accordance with this method, one or more non-erased frames of the encoded bit-stream are decoded to generate one or more corresponding frames of the output speech signal. An erased frame of the encoded bit-stream is then detected.

Responsive to the detection of the erased frame, a pitch period is estimated based on a previously-generated portion of the output speech signal, wherein deriving the pitch period comprises finding a lag that minimizes a sum of magnitude difference function (SMDF), and a frame of the output speech signal is generated corresponding to the erased frame, wherein generating the frame of the output speech signal corresponding to the erased frame includes extrapolating an extrapolated waveform based on the estimated pitch period.

Further features and advantages of the present invention, as well as the structure and operation of various embodiments of the present invention, are described in detail below with reference to the accompanying drawings. It is noted that the invention is not limited to the specific embodiments described herein. Such embodiments are presented herein for illustrative purposes only. Additional embodiments will be apparent to persons skilled in the art based on the teachings contained herein.

BRIEF DESCRIPTION OF THE DRAWINGS/FIGURES

The accompanying drawings, which are incorporated herein and form a part of the specification, illustrate one or more embodiments of the present invention and, together with the description, further serve to explain the purpose, advantages, and principles of the invention and to enable a person skilled in the art to make and use the invention.

Figure 1:
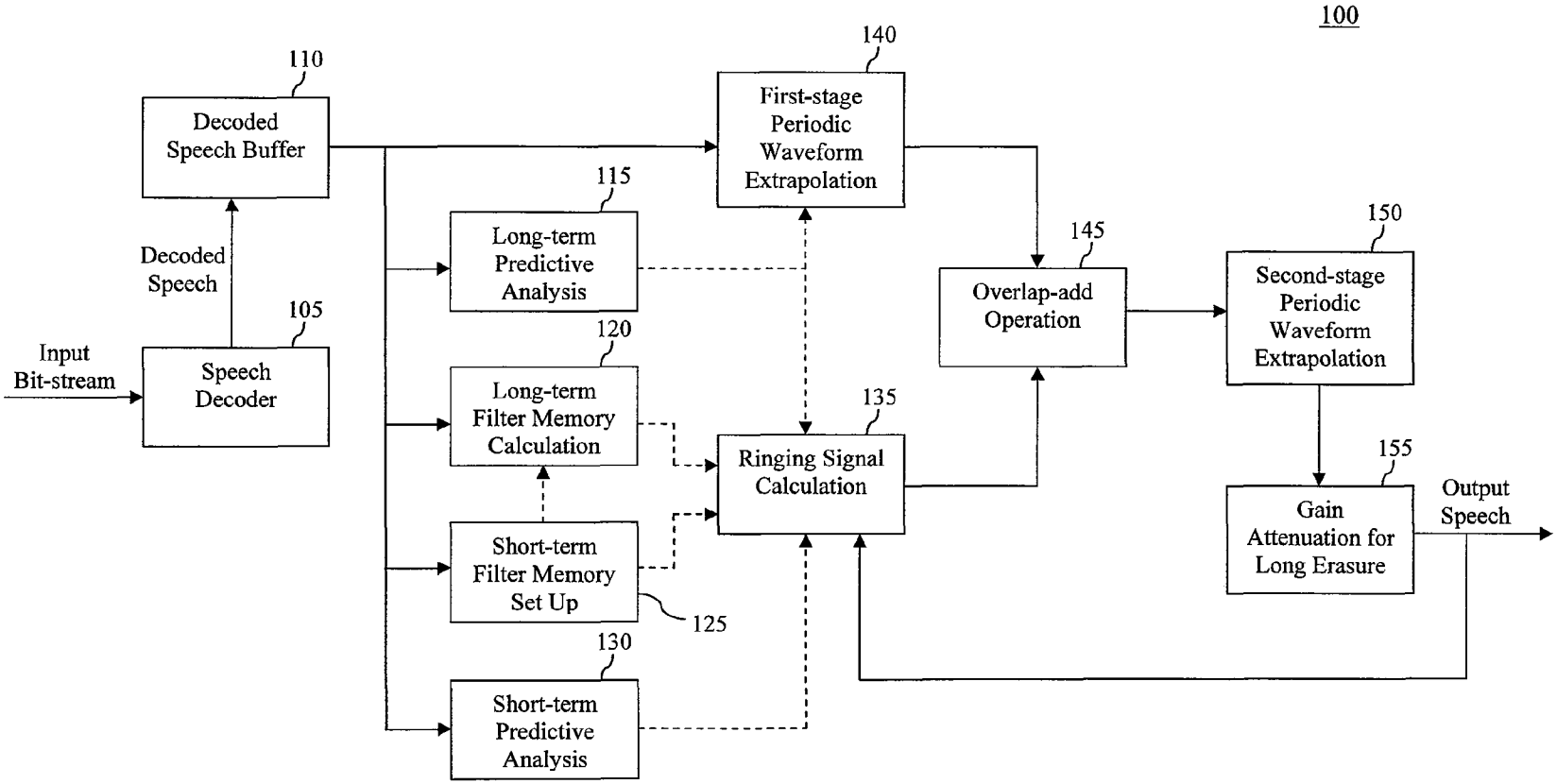
FIG. 1 is a block diagram of a system that implements a low-complexity frame erasure concealment (FEC) technique in accordance with an embodiment of the present invention.

The features and advantages of the present invention will become more apparent from the detailed description set forth below when taken in conjunction with the drawings, in which like reference characters identify corresponding elements throughout. In the drawings, like reference numbers generally indicate identical, functionally similar, and/or structurally similar elements. The drawing in which an element first appears is indicated by the leftmost digit(s) in the corresponding reference number.

DETAILED DESCRIPTION OF INVENTION

A. Introduction

The following detailed description refers to the accompanying drawings that illustrate exemplary embodiments of the present invention. However, the scope of the present invention is not limited to these embodiments, but is instead defined by the appended claims. Thus, embodiments beyond those shown in the accompanying drawings, such as modified versions of the illustrated embodiments, may nevertheless be encompassed by the present invention.

References in the specification to "one embodiment," "an embodiment," "an example embodiment," or the like, indicate that the embodiment described may include a particular feature, structure, or characteristic, but every embodiment may not necessarily include the particular feature, structure, or characteristic. Moreover, such phrases are not necessarily referring to the same embodiment. Furthermore, when a particular feature, structure, or characteristic is described in connection with an embodiment, it is submitted that it is within the knowledge of one skilled in the art to implement such feature, structure, or characteristic in connection with other embodiments whether or not explicitly described.

It should be understood that the while the following description of the present invention describes the processing of speech signals, the invention can be used to process any kind of general audio signal. Therefore, the term "speech" is used purely for convenience of description and is not limiting. Whenever the term "speech" is used, it can represent either speech or a general audio signal. Furthermore, it should also be understood that while most of the algorithm parameters described below are specified assuming a sampling rate of 8 kHz for telephone-bandwidth speech, persons skilled in the art should be able to extend the techniques presented below to other sampling rates, such as 16 kHz for wideband speech. Therefore, the parameters specified are only meant to be exemplary values and are not limiting.

B. System in Accordance with an Embodiment of the Present Invention

An exemplary FEC technique described below includes deriving a filter by analyzing previously-decoded speech, setting up an internal state (memory) of such a filter properly, calculating the "ringing" signal of the filter, and overlap-adding the resulting filter ringing signal with an extrapolated waveform to ensure a smooth waveform transition near frame boundaries without requiring additional delay as in G.711 Appendix I. In the context of the present invention, the "ringing" signal of a filter is the output signal of the filter when the input signal to the filter is set to zero.

The filter is chosen such that during the time period corresponding to the last several samples of the last good frame before a lost frame, the output signal of the filter is identical to the previously-decoded speech signal. Due to the generally non-zero internal "states" (memory) of the filter at the beginning of a lost frame, the output signal is generally non-zero even when the filter input signal is set to zero starting from the beginning of a lost frame. A filter ringing signal obtained this way has a tendency to continue the waveform at the end of the last good frame into the current lost frame in a smooth manner (that is, without obvious waveform discontinuity at the frame boundary). In one embodiment, the filter includes both a long-term predictive filter and a short-term predictive filter.

A long-term predictive filter normally requires a long signal buffer as its filter memory, thus adding significantly to the total memory size requirement. An embodiment of the present invention achieves a very low memory-size requirement by not maintaining a long buffer for the memory of the long-term predictive filter. Instead, the necessary portion of the filter memory is calculated on-the-fly when needed. The speech history buffer for the speech samples in the previous frames has a length of only 1 times the maximum pitch period plus the length of a predefined analysis window (rather than three and a half times as in G.711 Appendix I).

In one embodiment of the present invention, the long-term and short-term predictive filters are used to generate the ringing signal for overlap-add operation at the beginning of only the first bad frame of each occurrence of frame erasure. From the second consecutive bad frame on until the first good frame after the erasure, in place of the filter ringing signal, the system continues the waveform extrapolation of the previous frame to obtain a smooth extension of the speech waveform from the previous frame to the current frame, and uses such an extended waveform "as is" without overlap-add operation for the current bad frame or overlap-adds such an extended waveform with the decoded good waveform for the first good frame after the frame erasure.

According to one embodiment of the present invention, to reduce the average computational complexity which affects the battery life of portable devices such as Bluetooth headsets, minimal operations are performed in the good frames. Unlike the FEC scheme described in U.S. patent application Ser. No. 11/234,291, which performs significant speech analysis operations in the good frames to reduce the worst-case complexity in the bad frames, in an embodiment of the present invention the only operation performed in the good frames is the updating of the decoded speech buffer, except that the overlap-add operation is also performed in the first good frame after each erasure. Most of the operations are done in the bad frames. Since bad frames are usually a very small percentage of the total number of frames, the average computational complexity is quite low.

According to yet another embodiment of the present invention, to reduce the code size, periodic waveform extrapolation (PWE) is always used for every bad frame. In other words, there is no voicing measure or mixing of filtered white noise as described in U.S. patent application Ser. No. 11/234,291. Generally, doing PWE in every bad frame is likely to cause occasional buzz sounds when it sometimes introduces artificially created periodicity that is not in the original speech. However, in Bluetooth headset applications, a Continuously Variable Slope Delta-modulation (CVSD) codec is used with a small packet size of 30 samples (3.75 ms at 8 kHz sampling). Packet loss is usually isolated because Bluetooth links use frequency hopping and are usually interference-limited. In this case, each packet loss usually affects only 30 samples of speech, and PWL with a minimum pitch period greater than 20 samples usually does not cause any audible buzz sound, because there is not enough time for the extrapolated waveform to go through two pitch cycles, and thus it is not easy to perceive the artificially introduced periodicity.

According to yet another embodiment of the present invention, rather than using the popular normalized correlation function for pitch extraction and using sophisticated decision logic to avoid integer multiples of the pitch period, a very simple pitch extraction algorithm based on the average magnitude difference function (AMDF) is used. A coarse pitch period is first determined using a decimated speech signal directly (rather than using speech weighted by a weighting filter) by finding the time lag corresponding to the minimum AMDF. A pitch refinement search is then performed using the original undecimated speech with a refinement search window size determined by the coarse pitch period. The neighborhoods around the integer sub-multiples of this refined pitch period are then searched using a fixed refinement search window size, and the lowest sub-multiple within the pitch period range that gives an AMDF lower than a threshold is chosen as the final pitch period. If none of the sub-multiples gives an AMDF lower than a threshold, then the original refined pitch period is chosen as the final pitch period.

According to yet another embodiment of the present invention, if the total length of the consecutive packet loss exceeds a certain threshold, then an exponentially decaying gain function is applied to the extrapolated waveform so as to reduce the FEC output signal toward zero.

The present invention is particularly useful in the environment of the decoder of a block-independent speech codec. The general principles of the invention can be used in any block-independent codec. However, the invention is not limited to implementation in a block-independent codec, and the techniques described below may also be applied to other types of codecs including but not limited to predictive codecs.

An illustrative block diagram of a system 100 that performs frame erasure concealment (FEC) in accordance with an embodiment of the present invention is shown in FIG. 1. Generally speaking, system 100 is configured to decode an encoded bit-stream that has been received over a transmission medium to generate an output speech signal. In particular, system 100 is configured to decode discrete segments of the input bit-stream to produce corresponding discrete segments of the output speech signal. These discrete segments are termed frames. If a frame of the input-bit stream is corrupted, delayed or lost during transmission over the transmission medium, then the frame may be deemed "erased," which generally means that the frame is not available for decoding or cannot be reliably decoded. As will be described in more detail below, system 100 is configured to perform operations that conceal the quality-degrading effects associated with such frame erasure.

As used herein, the terms "erased frame" or "bad frame" are intended to denote a frame of the input bit-stream that has been deemed erased while the terms "received frame" or "good frame" are used to denote a frame of the input bit-stream that has not been deemed erased. Furthermore, as used herein, the term "erasure" refers to both a single erased frame as well as a series of consecutive erased frames.

In an embodiment, each frame of the input bit-stream processed by system 100 is classified into one of four different classes. These classes are (1) the first bad frame of an erasure—if the erasure consists of a consecutive series of bad frames, the first bad frame of the series is placed in this class and if the erasure consists of only a single bad frame then the single bad frame is placed in this class; (2) a bad frame that is not the first bad frame in an erasure consisting of a consecutive series of bad frames; (3) the first good frame immediately following an erasure; and (4) a good frame that is not the first good frame immediately after an erasure.

Figure 2:
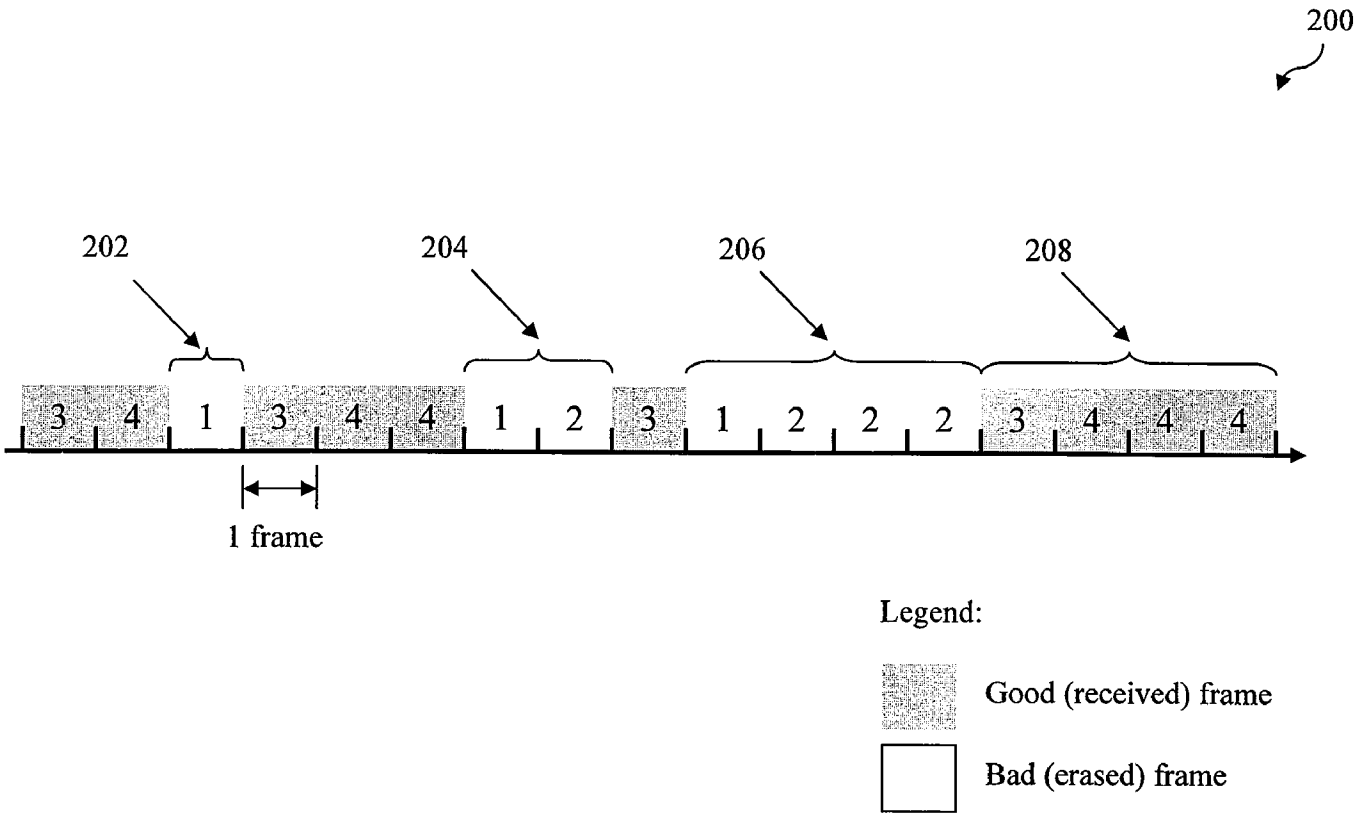
FIG. 2 is an illustration of different classes of frames of an input bit-stream distinguished by an embodiment of the present invention.

By way of illustration, FIG. 2 depicts a series of frames 200 of an input bit-stream that have been classified by system 100 in accordance with the foregoing classification scheme. In FIG. 2, the long horizontal arrowed line is a time line, with each vertical tick showing the location of the boundary between two adjacent frames. The further to the right a frame is located in FIG. 2, the newer (later) the frame is. Shaded frames represent good frames while frames that are not shaded represent bad frames.

As shown in FIG. 2, the series of frames 200 includes a number of erasures, including an erasure 202, an erasure 204 and an erasure 206. Erasure 202 consists of only a single bad frame, which is classified as a class 1 frame in accordance with the foregoing classification scheme. Erasures 204 and 206 each consist of a consecutive series of bad frames, wherein the first bad frame in each series is classified as a class 1 frame and each subsequent bad frame in each series is classified as a class 2 frame in accordance with the foregoing classification scheme. An exemplary series of good frames 208 following an erasure is also depicted in FIG. 2. In accordance with the foregoing classification scheme, the first good frame in series 208 is classified as a class 3 frame while the subsequent frames in series 208 are classified as class 4 frames.

As will be described in more detail herein, system 100 performs different tasks for different classes of frames. Furthermore, results generated while performing tasks for one class of frames may subsequently be used in processing other classes of frames. For this reason, it is difficult to illustrate the frame-by-frame operation of such an FEC scheme using a conventional block diagram. Accordingly, the block diagram of system 100 provided in FIG. 1 aims to illustrate the fundamental concepts of the FEC scheme rather than the step-by-step, module-by-module operation. Individual functional blocks in system 100 may be inactive or bypassed, depending on the class of frame that is being processed. The following description of system 100 will make clear which functional blocks are active during which class of frames.

In FIG. 1, the solid arrows indicate the flow of speech signals or other related signals within system 100. The arrows with dashed lines indicate the control flow involving the updates of filter parameters, filter memory, and the like.

The manner of operation of system 100 when the frame of the input bit-stream that is being processed is a good frame will now be described. In this case, block 105 decodes the frame of the input bit-stream to generate a corresponding frame of decoded speech and then passes the frame of decoded speech to block 110 for storage in a decoded speech buffer. The decoded speech buffer also stores a portion of a decoded speech signal corresponding to one or more previously-decoded frames. In one implementation, the length of the decoded speech signal corresponding to previously-decoded frames that can be accommodated by the decoded speech buffer is one times a maximum pitch period plus a predefined analysis window size. The maximum pitch period may be, for example, between 17 and 20 milliseconds (ms), while the analysis window size may be between 5 and 15 ms.

If the frame being processed is a good frame that is not the first good frame immediately after an erasure (that is, it is a class 4 frame), then blocks 115, 120, 125, 130 and 135 are inactive and blocks 140, 145, 150, and 155 are bypassed. In other words, the frame of the decoded speech signal produced by block 105 and stored in the decoded speech buffer is also provided as the output speech signal.

If, on the other hand, the frame being processed is the first good frame immediately after an erasure (that is, it is a class-3 frame), then due to the processing of the immediately previous frame (that is, the last bad frame of the last erasure), there should be a segment of a ringing signal already calculated and stored in block 135 (to be explained later). In this case, blocks 115, 120, 125 and 130 are inactive and block 140 is bypassed. Block 145 performs an overlap-add (OLA) operation between the ringing signal segment stored in block 135 and the frame of the decoded speech signal stored in the decoded speech buffer to obtain a smooth transition from the stored ringing signal to the decoded speech signal. This is done to avoid waveform discontinuity at the beginning of the current frame of the output speech signal. The overlap-add length is typically shorter than the frame size. Blocks 150 and 155 are then bypassed. That is, the overlap-added version of the frame of the decoded speech signal stored in the decoded speech buffer is directly played out as the output speech signal.

If the frame being processed is the first bad frame in an erasure (that is, it is a class 1 frame), the following speech analysis operations are performed by system 100. Using the decoded speech signal stored in the decoded speech buffer, block 115 performs a long-term predictive analysis to derive certain long-term filter related parameters (pitch period, long-term predictor tap weight, extrapolation scaling factor, and the like). Similarly, block 130 performs a short-term predictive analysis using the decoded speech signal stored in the decoded speech buffer to derive certain short-term filter parameters. The short term filter is also called the LPC (Linear Predictive Coding) filter in the speech coding literature.

Block 125 obtains a number of samples of the previous decoded speech signal, reverses the order, and saves them as short-term filter memory. Block 120 calculates the long-term filter memory by using a short-term filter to inverse-filter a segment of the decoded speech signal that is only one pitch period earlier than an overlap-add period at the beginning of the current output speech frame. The result of the inverse filtering is the short-term prediction residual or "LPC prediction residual" as known in the speech coding literature. Block 135 then scales the long-term filter memory segment so calculated by the long-term predictor tap weight, and then passes the resulting signal through a short-term synthesis filter whose coefficients are updated by block 130 and whose filter memory is set up by block 125. The output signal of such a short-term synthesis filter is the ringing signal to be used at the beginning of the current output speech frame (the first bad frame in an erasure).

Next, block 140 performs a first-stage periodic waveform extrapolation of the decoded speech signal up to the end of the overlap-add period, using the pitch period and an extrapolation scaling factor determined by block 115. Specifically, block 140 multiplies the decoded speech waveform segment that is one pitch period earlier than the current overlap-add period by the extrapolation scaling factor, and saves the resulting signal segment in the location corresponding to the current overlap-add period. Block 145 then performs the overlap-add operation to obtain a smooth transition from the ringing signal calculated by block 135 to the extrapolated speech signal generated by block 140. Next, block 150 performs a second-stage periodic waveform extrapolation from the end of the overlap-add period of the current output speech frame to the end of the overlap-add period in the next output speech frame (which is the end of the current output speech frame plus the overlap-add length). These extra samples beyond the end of the current output speech frame are not needed for generating the output samples of the current frame. They are calculated now and stored as the ringing signal for the overlap-add operation by block 145 for the next frame. Block 155 is bypassed, and the output of block 150 is directly played out as the output speech signal.

If the frame being processed is a bad frame that is not the first bad frame of an erasure (that is, it is a class 2 frame), blocks 120, 125, 130, and 135 are inactive. Block 115 does not perform another long-term predictive analysis to derive the long-term filter related parameters; instead, it just reuses those parameters derived at the first bad frame of this current erasure. Blocks 140 and 145 are bypassed and the ringing signal (extra samples extrapolated in the last bad frame) are used as the output speech samples for the overlap-add period of the current frame. Blocks 150 work the same way as for a class 1 frame; that is, it performs the second-stage periodic waveform extrapolation from the end of the overlap-add period of the current output speech frame to the end of the overlap-add period in the next output speech frame.

If the current bad frame is beyond the G-th consecutive bad frame in the current erasure, where G is a tunable parameter that typically corresponds to consecutive frame erasure of, for example, 20 ms, then block 155 applies gain attenuation to reduce the magnitude of the output speech signal toward zero. For simplicity, the gain scaling factor applied by block 155 is an exponentially decaying function that starts at a value of 1 at the beginning of the current bad frame and decays exponentially sample-by-sample toward zero. With an exemplary exponentially decaying factor of 127/128, the signal magnitude will be attenuated to 2.3% of its original value in about 60 ms from the start of the gain attenuation.

Figure 3:
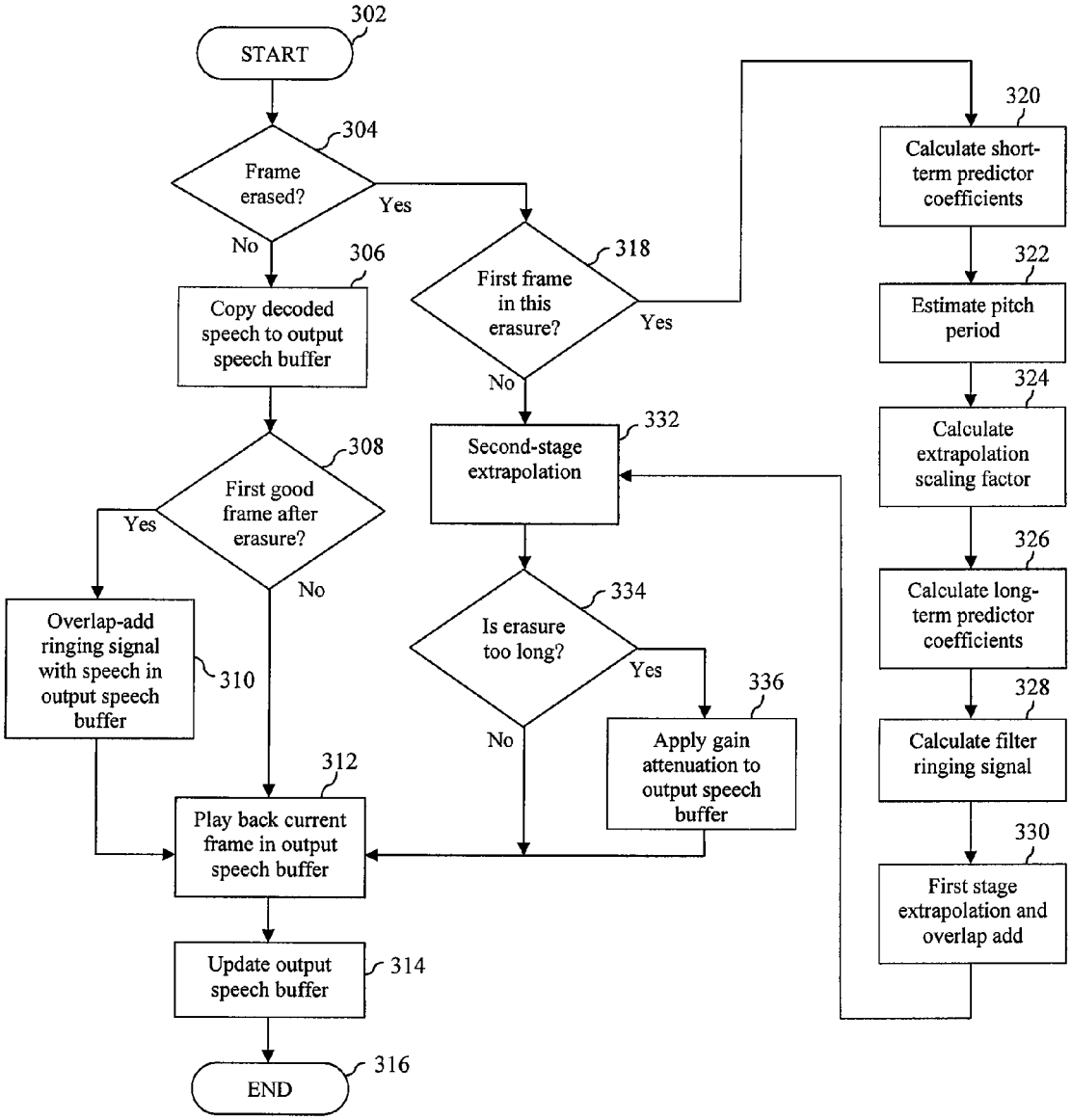
FIG. 3 is a flowchart of a method for performing low-complexity FEC in accordance with an embodiment of the present invention.

C. Frame Erasure Concealment Method in Accordance with an Embodiment of the Present Invention FIG. 3 depicts a flowchart 300 of a method of operation of system 100 in accordance with an embodiment of the present invention. Flowchart 300 is provided to help clarify the sequence of operations and control flow associated with the processing of each of the different classes of frames by system 100. Flowchart 300 describes steps involved in processing one frame of the input bit-stream received by system 100.

In FIG. 3, steps 304, 312, and 314 are performed during the processing of both good and bad frames of the input bit-stream. Steps 306, 308 and 310 are performed only during the processing of good frames of the input bit-stream. Steps 318, 320, 322, 324, 326, 328, 330, 332, 334 and 336 are performed only during the processing of bad frames of the input bit-stream.

As shown in FIG. 3, the processing of each frame of the input bit-stream begins at node 302, labeled "START." The first processing step is to determine whether the frame being processed is erased as shown at decision step 304. If the answer is "No" (that is, the frame being processed is a good frame), then at step 306 the decoded speech samples generated by decoding the frame are moved to a corresponding location in an output speech buffer. At decision step 308, a determination is made as to whether the frame being processed is the first good frame after an erasure. If the answer is "No" (that is, the current frame is a class 4 frame), the decoded speech samples in the output speech buffer corresponding to the frame being processed are directly played back as shown at step 312.

If the answer at decision step 308 is "Yes" (that is, the frame being processed is a class 3 frame), then an overlap-add (OLA) operation is performed at step 310. The OLA is performed between two signals: (1) the frame of decoded speech produced by decoding the current frame of the input bit-stream, and (2) a ringing signal calculated during processing of the previous frame of the input bit-stream for the beginning portion of the current frame, such that the output of the OLA operation gradually transitions from the ringing signal to the decoded speech signal associated with the current frame. Specifically, the ringing signal is "weighted" (that is, multiplied) by a "ramp-down" or "fade-out" window that goes from 1 to 0, and the decoded speech signal is weighted by a "ramp-up" or "fade-in" window that goes from 0 to 1. The two window-weighted signals are summed together, and the resulting signal is placed in the portion of the output speech buffer corresponding to the beginning portion of the decoded speech signal for the current frame, overwriting the decoded speech samples originally stored in that portion of the output speech buffer.

The sum of the ramp-down window and the ramp-up window at any given time index is 1. Various windows such as the triangular window or raised cosine window can be used. Such OLA operations are well known by persons skilled in the art. An example length of the overlap-add window (or the overlap-add length) used during step 310 is on the order of 2.5 ms, which is 20 samples for 8 kHz telephone-bandwidth speech and 40 samples for 16 kHz wideband speech.

After step 310 is completed, control flows to step 312, during which the decoded speech samples in the output speech buffer corresponding to the current frame (as modified by the OLA operation of step 310) are played back. Next, at step 314, the output speech buffer is updated in preparation for processing of the next frame of the input bit-stream. The update involves shifting the contents of the buffer by one frame of output speech in preparation for the next frame.

For convenience of description, a vector notation will be used to illustrate how step 314 and other steps work. Let the notation x(1:N) denote an N-dimensional vector containing the first through the N-th element of the x( ) array. In other words, x(1:N) is a short-hand notation for the vector [x(1) x(2) x(3) . . . x(N)] if x(1:N) is a row vector. Let xq( ) be the output speech buffer. Further let F be the output speech frame size in samples, Q be the number of previous output speech samples in the xq( ) buffer, and let L be the length of overlap-add operation used in steps 310 and 330 of flowchart 300. Then, the vector xq(1:Q) corresponds to the previous output speech samples up to the last sample of the last frame of output speech, the vector xq(Q+1:Q+F) corresponds to the current frame of output speech, and the vector xq(1:Q+L) corresponds to all speech samples up to the end of the overlap-add period of the current frame of output speech.

During step 314, the output speech buffer is shifted and updated. During this step, the vector xq(1+F:Q+L+F) is copied to the vector position occupied by xq(1:Q+L). In other words, the content of the output speech buffer is shifted by F samples. After such buffer update, control then flows to node 316, labeled "END", which represents the end of the frame processing loop. To process the next frame, control simply returns to node 302, labeled "START", and then the method of flowchart 300 is repeated.

Returning now to decision step 304, if the answer at that step is "Yes" (in other words, the frame of the input-stream that is being processed is erased), then at decision step 318 it is determined whether the erased frame is the first bad frame in an erasure. If the answer is "Yes", the erased frame is a class 1 frame. Responsive to determining that the erased frame is a class 1 frame, steps 320, 322, 324, 326, 328 and 330 are performed as described below.

During step 320, a so-called "LPC analysis" is performed to update the coefficients of a short-term predictor. Let M be the filter order of the short-term predictor. Then the short-term predictor can be represented by the transfer function $$P(z) = \sum_{i=1}^{M} a_i z^{-i},$$

where $\alpha_i$, i=1, 2, . . . , M are the short-term predictor coefficients. During step 320, the portion of the output speech signal stored in the vector xq(1:Q) is analyzed to calculate the short-term predictor coefficients $\alpha_i$, i=1, 2, . . . , M. Any reasonable analysis window size, window shape, and LPC analysis method can be used. Various methods for performing an LPC analysis are described in the speech coding literature. To reduce the computational complexity and the code size, one embodiment of the present invention uses a relatively small rectangular window (which is equivalent to no windowing operation at all), with a window size of 80 samples for 8 kHz sampling (10 ms), and with the window applied to xq(Q−79:Q), and the short-term predictor order M is 8. It should be noted that this is in direct contrast to conventional LPC analysis methods, which typically utilize a significantly more complex window, such as Hamming window. If even lower complexity is desired, the short-term predictor order M can be further reduced to a smaller number.

To reduce the computational complexity and the code size even further, one embodiment of the present invention uses a "switched-adaptive" short-term predictor. In this case, a few short-term predictors are pre-designed, and a classifier is used to switch between them. As an example, one can design off-line a short-term predictor optimized for voiced speech and a second short-term predictor optimized for unvoiced speech; then, by computing a voicing measure and comparing it with a threshold to determine whether the speech is likely voiced or unvoiced, step 320 can switch between these two pre-designed short-term predictors accordingly. This approach will save significant code size due to the elimination of the conventional LPC analysis, and it can also reduce the computational complexity if the voiced/unvoiced decision has a low complexity. In fact, it is even possible to use a fixed short-term predictor. However, it was found that such a fixed short-term predictor can occasionally give audible clicks in the output speech and thus is not recommended.

During step 322, a pitch period is estimated by analyzing the decoded speech stored in xq(1:Q), which corresponds to the last few good frames of the input bit-stream prior to the frame erasure. Pitch period estimation is well-known in the art. In principle, step 322 may use any one of a large number of possible pitch estimators to generate an estimated pitch period pp that may be used during steps 324, 326, 328, 330 and 332. One embodiment of the present invention uses a simple, low-complexity, and yet effective pitch estimator based on an average magnitude difference function (AMDF). This pitch estimator is described below.

To reduce the computational complexity, a coarse pitch period with reduced time resolution is first extracted by analyzing a 4:1 decimated speech signal. Due to this 4:1 decimation, the number of AMDF values that need to be calculated for a given pitch period range is reduced by a factor of 4, and for each AMDF the number of magnitude differences that need to be evaluated is also reduced by a factor of 4. Hence, when compared with an exhaustive AMDF search with full time resolution in the undecimated speech domain, the computational complexity is reduced by a factor of 4×4=16 when evaluating AMDF in this coarse pitch search in the 4:1 decimated domain.

This coarse pitch search algorithm is described below as Algorithm A. In the following description, DECF is the decimation factor, MIDPP is the middle point of the pitch period range, HPPR is half the pitch period range, PWSZ is the pitch analysis window size, and the symbol "←" means to update the variable on its left side with the expression on its right side. Note that the sum of magnitude difference (SMD) used in the algorithm below is closely related to AMDF, since AMDF is simply obtained by dividing SMD by the number of terms in the SMD calculation. Since each of the SMD values evaluated below has the same number of terms, minimizing the SMD is equivalent to minimizing the AMDF.

Algorithm A:

1. For lag from MIDPP−HPPR to MIDPP+HPPR with an increment of DECF, do the three steps in the indented part below:
   a. Initialize the sum of magnitude difference as smd=0 and initialize minsmd to a number larger than the frame size times the maximum magnitude value for speech samples.
   b. For n from Q−PWSZ+DECF to Q with an increment of DECF, do smd←smd+|xq(n)−xq(n−lag)|
   c. If smd<minsmd, then set minsmd=smd and set pp=lag.

At the end of the lag loop (step 1. above), the final value of pp is the desired coarse pitch period. As can be seen from the foregoing, Algorithm A is very simple, requiring only a small amount of code and low computational complexity. Note that conventional pitch estimators usually first filter the speech signal with a weighting filter to reduce the negative influence of the strong formant peaks on the accuracy of the pitch estimator, and then apply a low-pass anti-aliasing filter before performing decimation and the coarse pitch search. In contrast, the algorithm above uses the speech signal directly in the sum of magnitude difference calculation without using a weighting filter or an anti-aliasing filter. The omission of the weighting filter and the anti-aliasing filter reduces both the code size and the computational complexity, and it has been observed that such omission does not cause significant degradation of output speech quality.

By far the most popular metric used by pitch estimators to search for the pitch period is the correlation function or normalized correlation function. However, in fixed-point implementations, the correlation function has double the dynamic range of the speech signal. Furthermore, to avoid the square root operation, the normalized correlation function approach usually requires calculating the square of the correlation function which has four times the dynamic range of the speech signal. This means that fixed-point implementations of correlation-based pitch search algorithms usually have to keep track of an exponent or use the so-called "block floating-point" arithmetic to avoid overflow and keep sufficient precision at the same time. Thus, the resulting fixed-point implementation is usually quite complex and requires a large amount of code. In contrast, the SMD does not involve any multiplication and has the same dynamic range as the speech signal. As a result, the SMD-based Algorithm A above is very simple to implement in fixed-point arithmetic, and the amount of code used to implement Algorithm A should be considerably smaller than a correlation-based pitch search algorithm.

Once the coarse pitch has been estimated, a refined pitch search is performed in the neighborhood of the coarse pitch period. An adaptive pitch refinement search window size rfwsz is used and is selected to be the coarse pitch period or 10 ms, whichever is smaller. Note that to reduce the amount of code, Algorithm A described above is designed in such a way that it can be re-used for the pitch refinement search and pitch sub-multiple search (to be described below). To use it for the pitch refinement search, one just has to replace DECF by 1, replace PWSZ by rfwsz described above, replace MIDPP by the coarse pitch period, and replace HPPR by a small number such as 3. With such substitutions of parameter values, Algorithm A above performs the pitch refinement search, and the resulting pp is the refined pitch period pp. The resulting minsmd is assigned to rsmd.

The refined pitch period estimated in the manner described above may be an integer multiple of the true pitch period, especially for female speech. To avoid such a scenario, once the refined pitch period is obtained, a search around the neighborhoods of its integer sub-multiples is performed in the hope of finding the true pitch period if the refined pitch period is an integer multiple of the true pitch period. Algorithm B below may be used to perform this integer sub-multiple pitch search. Exemplary parameter values for 8 kHz sampling are MINPP=24, MAXSM=4, SMPSR=2, SMWSZ=30, and SMDTH=1.3. The function round(·) rounds off its argument to the nearest integer.

Algorithm B:

1. Set sm to the integer portion of pp/MINPP, where MINPP is the minimum allowed pitch period.
2. If sm>MAXSM, then set sm=MAXSM.
3. While sm<2, stop; otherwise, do the following steps.
4. Set pitch period sub-multiple to pps=round(pp/sm).
5. Use Algorithm A to find the lag in the neighborhood of pps that minimizes the SMD. Algorithm A is used with DECF replaced by 1, PWSZ replaced by SMWSZ, MIDPP replaced by pps, and HPPR replaced by SMPSR. The resulting output argument pp is assigned to the pitch period candidate ppc, and the resulting minsmd is assigned to smdc.
6. If smdc×rfwsz<SMDTH×SMWSZ×rsmd, then set the final pitch period pp=ppc, set rf,vsz=SMWSZ, and stop.
7. Decrement sm by 1. That is, sm←sm−1.
8. Go back to step 3.

To avoid division, 1/MINPP and 1/sm in Algorithm B above can be pre-calculated and stored. When this approach is used, the division becomes multiplication. Also, note that the condition smdc×rfwsz<SMDTH×SMWSZ×rsmd is equivalent to smdc/SMWSZ<SMDTH×(rsmd/rfwsz). Therefore, the condition is testing whether the new minimum AMDF at the pitch period candidate ppc is less than SMDTH times the minimum AMDF previously obtained during the pitch refinement search. If it is, then ppc is accepted as the final pitch period pp.

The example pitch period estimation algorithm described above for use in implementing step 322 is simple to implement, require only a small amount of code, has a low computational complexity, and yet is fairly effective, at least for FEC applications.

During step 324, an extrapolation scaling factor t is calculated that may be used during steps 328, 330 and 332. There are multiple ways to perform this function. One way is to calculate an optimal tap weight for a single-tap long-term predictor which predicts xq(Q−rfwsz+1:Q) by a weighted version of xq(Q−rfwsz+1−pp:Q−pp), where rfwsz is a pitch refinement search window size as discussed above in reference to step 322. The optimal weight, the derivation of which is well-known in the art, can be used as the extrapolation scaling factor t. One potential problem with this more conventional approach is that if the two waveform vectors xq(Q−rfwsz+1:Q) and xq(Q−rfwsz+1−pp:Q−pp) are not well-correlated (in other words, the normalized correlation is not close to 1), then the periodically extrapolated waveform calculated in steps 330 and 332 will tend to decay toward zero quickly. One way to avoid this problem is to divide the average magnitude of the vector xq(Q−rfwsz+1:Q) by the average magnitude of the vector xq(Q−rfwsz+1−pp:Q−pp), and use the resulting quotient as the extrapolation scaling factor t. The following Algorithm C calculates the extrapolation scaling factor t based on this principle.

Algorithm C:

1. Set smt=the sum of magnitudes for the vector xq(Q−rfwsz+1:Q)
2. Set smb=the sum of magnitudes for the vector xq(Q−rfwsz+1−pp:Q−pp)
3. If smt<smb, Set $t$=smt/smb otherwise, Set t=1

Note that smt≧0 and smb≧0. Therefore, if smt<smb, then smb>0 since smb>smt≧0. Hence, the expression t=smt/smb will not create a "divide-by-zero" problem. Furthermore, if the condition smt<smb is not true, then smt≧smb, and in this case t=smt/smb≧1, so t should be clipped to 1 to avoid a "blow up" of the output speech signal. Furthermore, Algorithm C above uses a single condition smt<smb to check for both the "divide-by-zero" problem and the need to clip t.

A long-term predictor tap weight, or the long-term filter memory scaling factor β that may be used in step 328, is calculated during step 326. One conventional way to obtain this value β is to calculate a short-term prediction residual signal first, and then calculate an optimal tap weight of the single-tap long-term predictor for this short-term prediction residual at a pitch period of pp. The resulting optimal tap weight can be used as β. However, doing so requires a long buffer for the short-term prediction residual signal. To reduce computational complexity and memory usage, it has been found that reasonable performance can be obtained by simply scaling the extrapolation scaling factor t by a positive value somewhat smaller than 1. It is found that calculating the long-term filter memory scaling factor as β=0.75×t provides good results.

During step 328, the ringing signal of a cascaded long-term synthesis filter and short-term synthesis filter is calculated for the first L samples of the output speech frame corresponding to the first bad frame in the current erasure. For voiced speech, this ringing signal tends to naturally "extend" the speech waveform in the previous frame of the output speech signal into the current frame in a smooth manner. Hence, it is useful to overlap-add the ringing signal with a periodically extrapolated speech waveform in process 330 to ensure a smooth waveform transition between the last good output speech frame and the output speech frame associated with the bad frame of the current erasure.

A common way to implement a single-tap all-pole long-term synthesis filter is to maintain a long delay line (that is, a "filter memory") with the number of delay elements equal to the maximum possible pitch period. Since the filter is an all-pole filter, the samples stored in this delay line are the same as the samples in the output of the long-term synthesis filter. To save the memory required by this long delay line, in one embodiment of the present invention, such a delay line is eliminated, and the portion of the delay line required for long-term filtering operation is approximated and calculated on-the-fly from the decoded speech buffer.

To calculate a filter ringing signal corresponding to the time period of xq(Q+1:Q+L), the portion of the long-term filter memory required for such operation is one pitch period earlier than the time period of xq(Q+1:Q+L). Let e(1:L) be the portion of the long-term synthesis filter memory (in other words, the long-term synthesis filter output) that when passed through the short-term synthesis filter will produce the desired filter ringing signal corresponding to the time period of xq(Q+1:Q+L). In addition, let pp be the pitch period to be used for the current frame. Then, the vector e(1:L) can be approximated by inverse short-term filtering of xq(Q+1−pp:Q+L−pp).

This inverse short-term filtering may be achieved by first assigning xq(Q+1−pp−M:Q−pp) as the initial memory (or "states") of a short-term predictor error filter, represented as A(z)=1−P(z), and then filtering the vector xq(Q+1−pp:Q+L−pp) with this properly initialized filter A(z). The corresponding filter output vector is the desired approximation of the vector e(1:L). Let us call this approximated vector ẽ(1:L). It is only an approximation because the coefficients of A(z) used in the current frame may be different from an earlier set of the coefficients of A(z) corresponding to the time period of xq(Q+1−pp:Q+L−pp) if pp is large.

Note that the vector xq(Q+1−pp−M:Q−pp) contains simply the M samples immediately prior to the vector xq(Q+1−pp:Q+L−pp) that is to be filtered, and therefore it can be used to initialize the memory of the all-zero filter A(z) so that it is as if the all-zero filter A(z) had been filtering the xq( ) signal since before it reaches this point in time.

After the inverse short-term filtering of the vector xq(Q+1−pp:Q+L−pp) with A(z), the resulting output vector ẽ(1:L) is multiplied by a long-term filter memory scaling factor β, which is an approximation of the tap weight for the single-tap long-term synthesis filter used for generating the ringing signal. The scaled long-term filter memory βẽ(1:L) is an approximation of the long-term synthesis filter output for the time period of xq(Q+1:Q+L). This scaled vector βẽ(1:L) is further passed through an all-pole short-term synthesis filter represented by 1/A(z) to obtain the desired filter ringing signal, designated as r(1:L). Before the 1/A(z) filtering operation starts, the filter memory of this all-pole filter 1/A(z) is initialized to xq(Q−M+1:Q)—namely, to the last M samples of the previous output speech frame. This filter memory initialization is done such that the delay element corresponding to $\alpha_i$ is initialized to the value of xq(Q+1−i) for i=1, 2, . . . , M.

Such filter memory initialization for the short-term synthesis filter 1/A(z) basically sets up the filter 1/A(z) as if it had been used in a filtering operation to generate xq(Q−M+1:Q), or the last M samples of the output speech in the last frame, and is about ready to filter the next sample xq(Q+1). By setting up the initial memory (filter states) of the short-term synthesis filter 1/A(z) this way, and then passing βẽ(1:L) through such a properly initialized short-term synthesis filter, a filter ringing signal will be produced that tends to naturally "extend" the speech waveform in the last frame into the current frame in a smooth manner.

After the filter ringing signal vector r(1:L) is calculated in step 328, this ringing vector r(1:L) is used in the overlap-add operation of step 330.

During step 330, the operations of blocks 140 and 145 as described above in reference to FIG. 1 are performed. Specifically, let t be the extrapolation scaling factor, and assume that the pitch period is greater than the overlap-add period (i.e., pp≧L), then step 330 involves first calculating xq(Q+1:Q+L)=t×xq(Q+1−pp:Q+L−pp). Next, xq(Q+1:Q+L) is overlap-added with r(1:L). That is, xq(Q+n)=wu(n)×xq(Q+n)+wd(n)×r(n), for n=1, 2, . . . , L, where wu(n) and wd(n) are the n-th sample of the ramp-up window and ramp-down window, respectively, and wu(n)+wd(n)=1.

If the pitch period is smaller than the overlap-add period (pp<L), the first-stage extrapolation can be performed in a sample-by-sample manner to avoid copying waveform discontinuity from the beginning of the frame to a pitch period later before the overlap-add operation is performed. Specifically, the first-stage extrapolation with overlap-add may be performed by the following algorithm.

For n from 1, 2, 3, . . . , to L, do the next line:

$$xq(Q+n)=wu(n)\times t\times xq(Q+n-pp)+wd(n)\times r(n)$$

This algorithm works regardless of the relationship between pp and L. Thus, in an embodiment it may be used in all cases to avoid the checking of the relationship between pp and L.

After this first-stage extrapolation with overlap-add, the flow continues to step 332 of flowchart 300.

Referring back now to decision step 318 of flowchart 300, if the answer to the question in that decision step is "No" (that is, the current frame is a class 2 frame), then control flows to step 332.

During step 332, the output speech signal is further extrapolated from the (L+1)-th sample of the current frame to L samples after the end of the current frame. This second-stage extrapolation is carried out as xq(Q+L+1:Q+F+L)=t×xq(Q+L+1−pp:Q+F+L−pp). The extra L samples of extrapolated speech past the end of the current frame of output speech, namely, the samples in xq(Q+F+1:Q+F+L), is considered the "ringing signal" for the overlap-add operation at the beginning of the first good frame after the current erasure (a class 3 frame).

Next, during decision step 334, it is determined whether the current erasure is too long—that is, whether the current frame is too "deep" into the erasure. A reasonable threshold is somewhere around 20 to 30 ms. If the length of the current erasure has not exceeded such a threshold, then control flows to step 312 in FIG. 3, during which the current frame of output speech is played back from the output speech buffer. If the length of the current erasure has exceeded this threshold, then gain attenuation is applied in step 336 which has the effect of gradually reducing the magnitude of the output signal toward zero, and then control flows to step 312.

This gain attenuation toward zero is important, because extrapolating a waveform for too long will cause the output signal to sound unnaturally tonal and buzzy, which will be perceived as fairly bad artifacts. To avoid the unnatural tonal and buzzy sound, it is reasonable to attenuate the output signal to zero after about 60 ms to 80 ms into a long erasure. Persons skilled in the relevant art will understand that there are various ways to perform such gain attenuation.

One embodiment of the present invention uses a simple sample-by-sample exponentially decaying scheme that is simple to implement, requires only a small amount of code, and is low in computational complexity. This gain attenuation algorithm is described below. The variable cfecount is a counter that counts how many consecutive frames into the current erasure the current bad frame is. An exemplary value of the gain attenuation starting frame number GATTST is 7 for a packet size of 30 samples at 8 kHz sampling. An exemplary value of the gain attenuation factor GATTF is 127/128 for 8 kHz sampling.

Algorithm D:

1. If cfecount≧GATTST, then do the following steps in the indented part:
   a. Set gain=1.
   b. For n=Q+1, Q+2, Q+3, . . . , Q+F+L, do next two steps
      i. Set gain←gain×GATTF
      ii. Set xq(n)←gain×xq(n)

After the attenuation of the speech signal in xq(Q+1:Q+F+L) during step 336, control flows to step 312. This completes the description of the flow chart in FIG. 3.

D. Example Computer System Implementation

Figure 4:
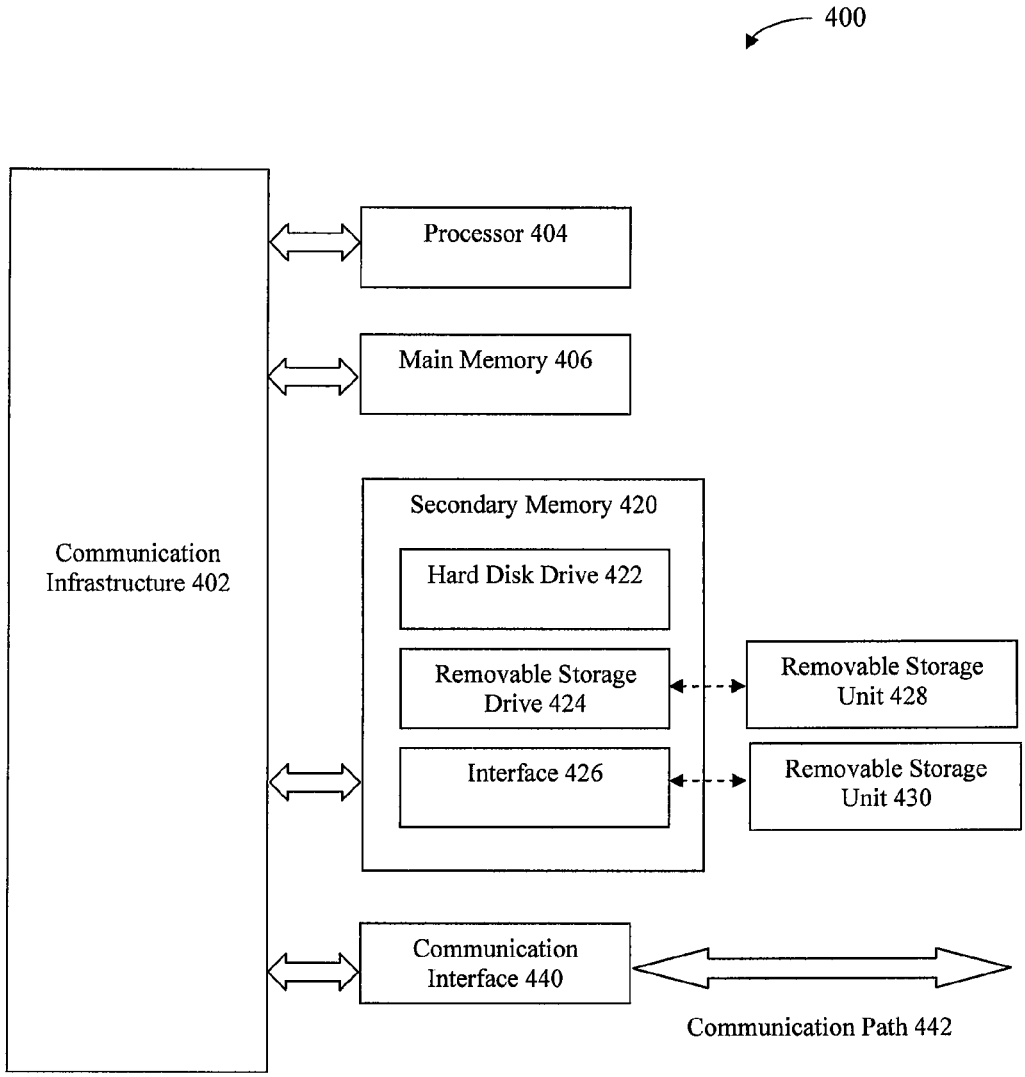
FIG. 4 is a block diagram of an example computer system that may be configured to implement an embodiment of the present invention.

The following description of a general purpose computer system is provided for the sake of completeness. The present invention can be implemented in hardware, or as a combination of software and hardware. Consequently, the invention may be implemented in the environment of a computer system or other processing system. An example of such a computer system 400 is shown in FIG. 4. In the present invention, all of the blocks of system 100 depicted in FIG. 1 as well as all of the steps depicted in flowchart 300 of FIG. 3, for example, can execute on one or more distinct computer systems 400, to implement the various methods of the present invention.

Computer system 400 includes one or more processors, such as processor 404. Processor 404 can be a special purpose or a general purpose digital signal processor. Processor 404 is connected to a communication infrastructure 402 (for example, a bus or network). Various software implementations are described in terms of this exemplary computer system. After reading this description, it will become apparent to a person skilled in the relevant art(s) how to implement the invention using other computer systems and/or computer architectures.

Computer system 400 also includes a main memory 406, preferably random access memory (RAM), and may also include a secondary memory 420. Secondary memory 420 may include, for example, a hard disk drive 422 and/or a removable storage drive 424, representing a floppy disk drive, a magnetic tape drive, an optical disk drive, or the like. Removable storage drive 424 reads from and/or writes to a removable storage unit 428 in a well known manner. Removable storage unit 428 represents a floppy disk, magnetic tape, optical disk, or the like, which is read by and written to by removable storage drive 424. As will be appreciated by persons skilled in the relevant art(s), removable storage unit 428 includes a computer usable storage medium having stored therein computer software and/or data.

In alternative implementations, secondary memory 420 may include other similar means for allowing computer programs or other instructions to be loaded into computer system 400. Such means may include, for example, a removable storage unit 430 and an interface 426. Examples of such means may include a program cartridge and cartridge interface (such as that found in video game devices), a removable memory chip (such as an EPROM, or PROM) and associated socket, and other removable storage units 430 and interfaces 426 which allow software and data to be transferred from removable storage unit 430 to computer system 400.

Computer system 400 may also include a communications interface 440. Communications interface 440 allows software and data to be transferred between computer system 400 and external devices. Examples of communications interface 440 may include a modem, a network interface (such as an Ethernet card), a communications port, a PCMCIA slot and card, etc. Software and data transferred via communications interface 440 are in the form of signals which may be electronic, electromagnetic, optical, or other signals capable of being received by communications interface 440. These signals are provided to communications interface 440 via a communications path 442. Communications path 442 carries signals and may be implemented using wire or cable, fiber optics, a phone line, a cellular phone link, an RF link and other communications channels.

As used herein, the terms "computer program medium" and "computer usable medium" are used to generally refer to media such as removable storage units 428 and 430 or a hard disk installed in hard disk drive 422. These computer program products are means for providing software to computer system 400.

Computer programs (also called computer control logic) are stored in main memory 406 and/or secondary memory 420. Computer programs may also be received via communications interface 440. Such computer programs, when executed, enable the computer system 400 to implement the present invention as discussed herein. In particular, the computer programs, when executed, enable processor 400 to implement the processes of the present invention, such as any of the methods described herein. Accordingly, such computer programs represent controllers of the computer system 400. Where the invention is implemented using software, the software may be stored in a computer program product and loaded into computer system 400 using removable storage drive 424, interface 426, or communications interface 440.

In another embodiment, features of the invention are implemented primarily in hardware using, for example, hardware components such as application-specific integrated circuits (ASICs) and gate arrays. Implementation of a hardware state machine so as to perform the functions described herein will also be apparent to persons skilled in the relevant art(s).

E. Conclusion

While various embodiments of the present invention have been described above, it should be understood that they have been presented by way of example, and not limitation. It will be apparent to persons skilled in the relevant art that various changes in form and detail can be made therein without departing from the spirit and scope of the invention. For example, although a preferred embodiment of the present invention described herein utilizes a long-term predictive filter and a short-term predictive filter to generate a ringing signal, persons skilled in the relevant art(s) will appreciate that a ringing signal may be generated using a long-term predictive filter only or a short-term predictive filter only. Additionally, the invention is not limited to the use of predictive filters, and persons skilled in the relevant art(s) will understand that long-term and short-term filters in general may be used to practice the invention.

The present invention has been described above with the aid of functional building blocks and method steps illustrating the performance of specified functions and relationships thereof. The boundaries of these functional building blocks and method steps have been arbitrarily defined herein for the convenience of the description. Alternate boundaries can be defined so long as the specified functions and relationships thereof are appropriately performed. Any such alternate boundaries are thus within the scope and spirit of the claimed invention. One skilled in the art will recognize that these functional building blocks can be implemented by discrete components, application specific integrated circuits, processors executing appropriate software and the like or any combination thereof. Thus, the breadth and scope of the present invention should not be limited by any of the above-described exemplary embodiments, but should be defined only in accordance with the following claims and their equivalents.

What is claimed is:

1. A method for processing a series of erased frames of an encoded-bit stream to generate corresponding frames of an output speech signal, comprising:

generating a frame of the output speech signal corresponding to a first erased frame in the series of erased frames by:

extrapolating a first extrapolated waveform segment based on a first previously-generated portion of the output speech signal, deriving a long-term synthesis filter and a short-term synthesis filter based on an analysis of a portion of the output speech signal that was previously generated by a decoder and stored in a decoded speech buffer and using the long-term and short-term synthesis filters to obtain a ringing signal segment, overlap-adding the ringing signal segment to the first extrapolated waveform segment to generate an overlap-added waveform segment, extrapolating a second extrapolated waveform segment based on the first previously-generated portion of the output speech signal and/or the overlap-added waveform segment, and appending a first portion of the second extrapolated waveform segment to the overlap-added waveform segment to generate the frame of the output speech signal corresponding to the first erased frame; and generating a frame of the output speech signal corresponding to a subsequent erased frame in the series of erased frames by:

extrapolating a third extrapolated waveform segment based on a second previously-generated portion of the output speech signal, and appending a first portion of the third extrapolated waveform segment to a second portion of the second extrapolated waveform segment to generate the frame of the output speech signal corresponding to the subsequent erased frame.

2. The method of claim 1, wherein deriving the short-term synthesis filter comprises selecting one of a plurality of pre-designed short-term synthesis filters.

3. The method of claim 2, wherein selecting one of the plurality of pre-designed short-term synthesis filters comprises selecting one of the plurality of pre-designed short-term synthesis filters based on a voicing measure associated with the portion of the output speech signal that was previously generated by the decoder and stored in the decoded speech buffer.

4. The method of claim 1, further comprising calculating an extrapolation scaling factor for use in each of the extrapolation steps.

5. The method of claim 4, wherein calculating the extrapolation scaling factor comprises dividing a sum of magnitudes of a first previously-generated segment of the output speech signal by a sum of magnitudes of a second previously-generated segment of the output speech signal, wherein the second previously-generated segment is one estimated pitch period earlier than the first previously-generated segment.

6. The method of claim 1, further comprising:

receiving a first non-erased frame of the encoded bit-stream after receiving the series of erased frames of the encoded bit-stream; and responsive to receiving the first non-erased frame:

decoding the first non-erased frame to generate a decoded frame, and overlap adding a portion of an extrapolated waveform segment generated during the processing of the last erased frame in the series of erased frames to a portion of the decoded frame to generate a frame of the output speech signal corresponding to the first non-erased frame.

7. A method for processing frames of an encoded bit-stream to generate corresponding frames of an output speech signal comprising:

decoding one or more non-erased frames of the encoded bit-stream to generate one or more corresponding frames of the output speech signal;

detecting a first erased frame of the encoded bit-stream; and responsive to detecting the first erased frame:

deriving a short-term synthesis filter, wherein deriving the short-term synthesis filter includes calculating short-term synthesis filter coefficients and setting up a short-term synthesis filter memory based on an analysis of a portion of the output speech signal that was previously generated by a decoder and stored in a decoded speech buffer, deriving a long-term synthesis filter, wherein deriving the long-term synthesis filter includes calculating a pitch period, a long-term synthesis filter memory, and a long-term synthesis filter memory scaling factor based on an analysis of the portion of the output speech signal that was previously generated by the decoder and stored in the decoded speech buffer, calculating a ringing signal segment based on the long-term synthesis filter and the short-term synthesis filter, and generating a frame of the output speech signal corresponding to the first erased frame wherein generating the frame of the output speech signal corresponding to the first erased frame comprises overlap adding the ringing signal segment to an extrapolated waveform.

8. The method of claim 7, wherein decoding the one or more non-erased frames of the encoded bit-stream comprises performing Continuously Variable Slope Delta-modulation (CVSD) decoding.

9. The method of claim 7, wherein calculating the short-term synthesis filter coefficients comprises performing a Linear Predictive Coding (LPC) analysis on the portion of the output speech signal that was previously generated by the decoder and stored in the decoded speech buffer.

10. The method of claim 9, wherein performing an LPC analysis on the portion of the output speech signal that was previously generated by the decoder and stored in the decoded speech buffer comprises performing the LPC analysis using a rectangular analysis window.

11. The method of claim 7, wherein setting up the short-term synthesis filter memory comprises:

obtaining a series of samples from the portion of the output speech signal that was previously generated by the decoder and stored in the decoded speech buffer; and storing the samples in the reverse order.

12. The method of claim 7, wherein calculating the pitch period includes:

calculating a sum of magnitude difference (SMD) between a first segment of the portion of the output speech signal portion that was previously generated by the decoder and stored in the decoded speech buffer and each of a plurality of second segments of the portion of the output speech signal that was previously generated by the decoder and stored in the decoded speech buffer, wherein each of the second segments is delayed with respect to the first segment by a unique lag;

identifying the second segment that produced the smallest SMD during the calculating step; and estimating the pitch period as the unique lag associated with the identified second segment.

13. The method of claim 7, wherein calculating the long-term synthesis filter memory comprises inverse short-term filtering the portion of the output speech signal that was previously generated by the decoder and stored in the decoded speech buffer.

14. The method of claim 7, wherein calculating the long-term synthesis filter memory scaling factor comprises scaling an extrapolation scaling factor by a positive value smaller than 1.

15. The method of claim 14, further comprising:

calculating the extrapolation scaling factor by dividing a sum of magnitudes of a first previously-generated segment of the output speech signal by a sum of magnitudes of a second previously-generated segment of the output speech signal, wherein the second previously-generated segment is one estimated pitch period earlier than the first previously-generated segment.

16. A method for processing frames of an encoded bit-stream to generate corresponding frames of an output speech signal comprising:

decoding one or more non-erased frames of the encoded bit-stream to generate one or more corresponding frames of the output speech signal;

detecting a first erased frame of the encoded bit-stream; and responsive to detecting the first erased frame:

deriving a long-term synthesis filter and a short-term synthesis filter based on an analysis of portions of the output speech signal that were previously generated by a decoder and stored in a decoded speech buffer, wherein deriving the long-term filter comprises estimating a pitch period based on an analysis of a portion of the output speech signal that was previously generated by the decoder and stored in the decoded speech buffer, and wherein estimating the pitch period comprises finding a lag that minimizes a sum of magnitude difference function (SMDF), calculating a ringing signal segment based on the long-term synthesis filter and the short-term synthesis filter, and generating a frame of the output speech signal corresponding to the first erased frame wherein generating the frame of the output speech signal corresponding to the first erased frame comprises overlap adding the ringing signal segment to an extrapolated waveform.

17. The method of claim 16, wherein deriving the short-term synthesis filter comprises selecting one of a plurality of pre-designed short-term synthesis filters.

18. The method of claim 17, wherein selecting one of the plurality of pre-designed short-term synthesis filters comprises selecting one of the plurality of pre-designed short-term synthesis filters based on a voicing measure associated with a previously-generated portion of the output speech signal.

19. The method of claim 16, wherein decoding the one or more non-erased frames of the encoded bit-stream comprises performing Continuously Variable Slope Delta-modulation (CVSD) decoding.

20. The method of claim 16, wherein estimating the pitch period comprises:

calculating a sum of magnitude difference (SMD) between a first segment of the portion of the output speech signal that was previously generated by the decoder and stored in the decoded speech buffer and each of a plurality of second segments of the portion of the output speech signal that was previously generated by the decoder and stored in the decoded speech buffer, wherein each of the second segments is delayed with respect to the first segment by a unique lag;

identifying the second segment that produced the smallest SMD during the calculating step; and estimating the pitch period as the unique lag associated with the identified second segment.

21. The method of claim 16, wherein estimating the pitch period does not include filtering the portion of the output speech signal that was previously generated by the decoder and stored in the decoded speech buffer with a weighting filter or passing the portion of the output speech signal that was previously generated by the decoder and stored in the decoded speech buffer through a low-pass anti-aliasing filter.

22. The method of claim 16, further comprising:

decimating the portion of the output speech signal that was previously generated by the decoder and stored in the decoded speech buffer prior to or during calculation of the SMD between the first segment and each of the second segments.

23. The method of claim 22, further comprising:

estimating a refined pitch period by identifying a unique lag within a predefined range of the pitch period that minimizes a first SMDF.

24. The method of claim 23, wherein estimating the refined pitch period further comprises:

performing a pitch period search within a predefined range around each of a plurality of integer sub-multiples of the refined pitch period, wherein each pitch period search comprises identifying a unique lag within each predefined range that minimizes one of a plurality of second SMDFs.

25. A method for processing frames of an encoded bit-stream to generate corresponding frames of an output speech signal comprising:

decoding one or more non-erased frames of the encoded bit-stream to generate one or more corresponding frames of the output speech signal;

detecting an erased frame of the encoded bit-stream; and responsive to detecting the erased frame:

estimating a pitch period based on an analysis of a portion of the output speech signal that was previously generated by a decoder and stored in a decoded speech buffer, wherein deriving the pitch period comprises finding a lag that minimizes a sum of magnitude difference function (SMDF), and generating a frame of the output speech signal corresponding to the erased frame, wherein generating the frame of the output speech signal corresponding to the erased frame includes extrapolating an extrapolated waveform based on the estimated pitch period.

26. The method of claim 25, wherein decoding the one or more non-erased frames of the encoded bit-stream comprises performing Continuously Variable Slope Delta-modulation (CVSD) decoding.

27. The method of claim 25, wherein estimating the pitch period comprises:

calculating a sum of magnitude difference (SMD) between a first segment of the portion of the output speech signal that was previously generated by a decoder and stored in a decoded speech buffer and each of a plurality of second segments of the portion of the output speech signal that was previously generated by a decoder and stored in a decoded speech buffer, wherein each of the second segments is delayed with respect to the first segment by a unique lag;

identifying the second segment that produced the smallest SMD during the calculating step; and estimating the pitch period as the unique lag associated with the identified second segment.

28. The method of claim 27, wherein estimating the pitch period does not include filtering the portion of the output speech signal that was previously generated by a decoder and stored in a decoded speech buffer with a weighting filter or passing the portion of the output speech signal that was previously generated by a decoder and stored in a decoded speech buffer through a low-pass anti-aliasing filter.

29. The method of claim 27, further comprising:

decimating the portion of the output speech signal that was previously generated by a decoder and stored in a decoded speech buffer prior to or during calculation of the SMD between the first segment and each of the second segments.

30. The method of claim 29, further comprising:

estimating a refined pitch period by identifying a unique lag within a predefined range of the pitch period that minimizes an SMDF.

31. The method of claim 30, wherein estimating the refined pitch period further comprises:

performing a pitch period search within a predefined range around each of a plurality of integer sub-multiples of the refined pitch period, wherein each pitch period search comprises identifying a unique lag within each predefined range that minimizes an SMDF.

* * * * *